US006695156B1

(12) United States Patent
Wang

(10) Patent No.: US 6,695,156 B1
(45) Date of Patent: Feb. 24, 2004

(54) RACK DEVICE HAVING REVERSIBLE OR INVERTIBLE SHELVES

(76) Inventor: Chang Chou Wang, No. 62, Lane 627, Sec. 7, Er Shi Road, Er Lin Town, Chang Hua Hsien (TW), 526

( * ) Notice: Subject to any disclaimer, the term of this patent is extended or adjusted under 35 U.S.C. 154(b) by 0 days.

(21) Appl. No.: 10/316,528

(22) Filed: Dec. 12, 2002

(51) Int. Cl.[7] ..... A47B 57/32; A47F 5/14

(52) U.S. Cl. ..... 211/187; 108/147.11; 108/147.13; 108/147.15; 211/181.1

(58) Field of Search ..... 211/181.1, 187; 108/144.11, 147.11, 147.12, 147.13, 147.15, 147.19, 147.18

(56) References Cited

U.S. PATENT DOCUMENTS

| | | | | | |
|---|---|---|---|---|---|
| 4,627,543 | A | * | 12/1986 | Nicely | 211/187 |
| 4,656,952 | A | * | 4/1987 | Schweizer | 108/147.13 |
| 5,676,263 | A | | 10/1997 | Chang | 211/187 |
| 5,960,968 | A | | 10/1999 | Wang | 211/187 |
| 6,015,052 | A | * | 1/2000 | Goldberg et al. | 211/187 |
| 6,036,033 | A | | 3/2000 | Chang | 211/182 |
| 6,079,575 | A | * | 6/2000 | Wang | 211/187 |
| 6,257,426 | B1 | * | 7/2001 | Masunaka et al. | 211/187 |
| 6,357,611 | B1 | * | 3/2002 | Chen | 211/187 |
| 6,364,138 | B1 | * | 4/2002 | Chen | 211/187 |
| 6,550,730 | B1 | * | 4/2003 | Hong | 211/187 |
| 2002/0113180 | A1 | * | 8/2002 | Wiebe | 108/147.13 |
| 2003/0131767 | A1 | * | 7/2003 | Chen | 108/147.13 |

* cited by examiner

*Primary Examiner*—Daniel P. Stodola
*Assistant Examiner*—Erica B Harris
(74) *Attorney, Agent, or Firm*—Charles E. Baxley

(57) ABSTRACT

A rack device includes one or more shelves, each having one or more collars for being detachably secured onto one or more posts with one or more sleeves. The sleeve includes an enlarged lower portion. The collar includes a bore for receiving the sleeve, and having a narrower middle portion and two greater end portions, for allowing the collar to be invertibly secured onto the enlarged lower portion of the sleeve, and for allowing either of the upper and the lower sides of the shelf to be arranged on the upper portion for supporting various objects.

9 Claims, 8 Drawing Sheets

RACK DEVICE HAVING REVERSIBLE OR INVERTIBLE SHELVES

BACKGROUND OF THE INVENTION

1. Field of the Invention

The present invention relates to a rack device, and more particularly to a rack device including one or more reversible or invertible shelves.

2. Description of the Prior Art

Various kinds of typical rack devices, shelves, or construction assemblies have been developed for being constructed by the users themselves, and comprise a number of shelves to be quickly assembled or attached onto four posts, without additional fasteners.

U.S. Pat. No. 5,676,263 to Chang, U.S. Pat. No. 5,960,968 to Wang, and U.S. Pat. No. 6,036,033 to Chang disclose three of the typical rack devices each having a number of shelves that may be assembled onto four posts by the users. However, the shelves are not reversible or invertible, such that the shelves may have only one usable side.

The present invention has arisen to mitigate and/or obviate the afore-described disadvantages of the conventional rack devices.

SUMMARY OF THE INVENTION

The primary objective of the present invention is to provide a rack device including one or more reversible or invertible shelves, for allowing both sides of the shelves to be selectively used.

In accordance with one aspect of the invention, there is provided a rack device comprising at least one post; a sleeve engaged onto the post, including a lower portion having an outer diameter greater than an outer diameter of an upper portion thereof; a shelf, and at least one collar secured to the shelf, including a bore formed therein for receiving the sleeve and for securing the collar and the shelf to the sleeve and the post. The bore of the collar includes two end portions and a middle portion having an inner diameter smaller than an inner diameter of the end portions thereof. The inner diameter of the middle portion of the bore of the collar is no less than the outer diameter of the upper portion of the sleeve, which permits either of the end portions of the bore of the collar to receive the upper portion of the sleeve, and the outer diameter of the lower portion of the sleeve is greater than the inner diameter of the middle portion of the bore of the collar, which retains the collar on the sleeve when either of the end portions of the bore of the collar receives the lower portion of the sleeve. Either of the sides, such as the upper and the lower sides of the shelf may be inverted, for allowing either of the sides to be arranged on the upper portion for supporting various objects.

The lower portion of the sleeve preferably includes a frustum-shaped structure. The sleeve includes a peripheral flange extended from the lower portion thereof for engaging with the collar, and for stably retaining the collar on the sleeve. The peripheral flange of the sleeve includes an outer diameter equal to that of the end portions of the collar.

The sleeve includes a peripheral rib extended from the upper portion thereof. The collar includes an inner peripheral surface for defining the bore thereof, the peripheral rib of the sleeve is engaged with the inner peripheral surface of the collar to enclose the bore of the collar.

The sleeve includes a first half including at least one notch formed therein, and a second half having at least one ear extended therefrom and engageable into the notch of the first half of the sleeve.

The post includes an outer peripheral portion having a plurality of grooves formed therein, the sleeve includes at least one stop extended therefrom for engaging with either of the grooves of the post.

The shelf includes a planar base member, and a peripheral wall member extended from a peripheral portion of the planar base member, and selectively disposed either above or below the planar base member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
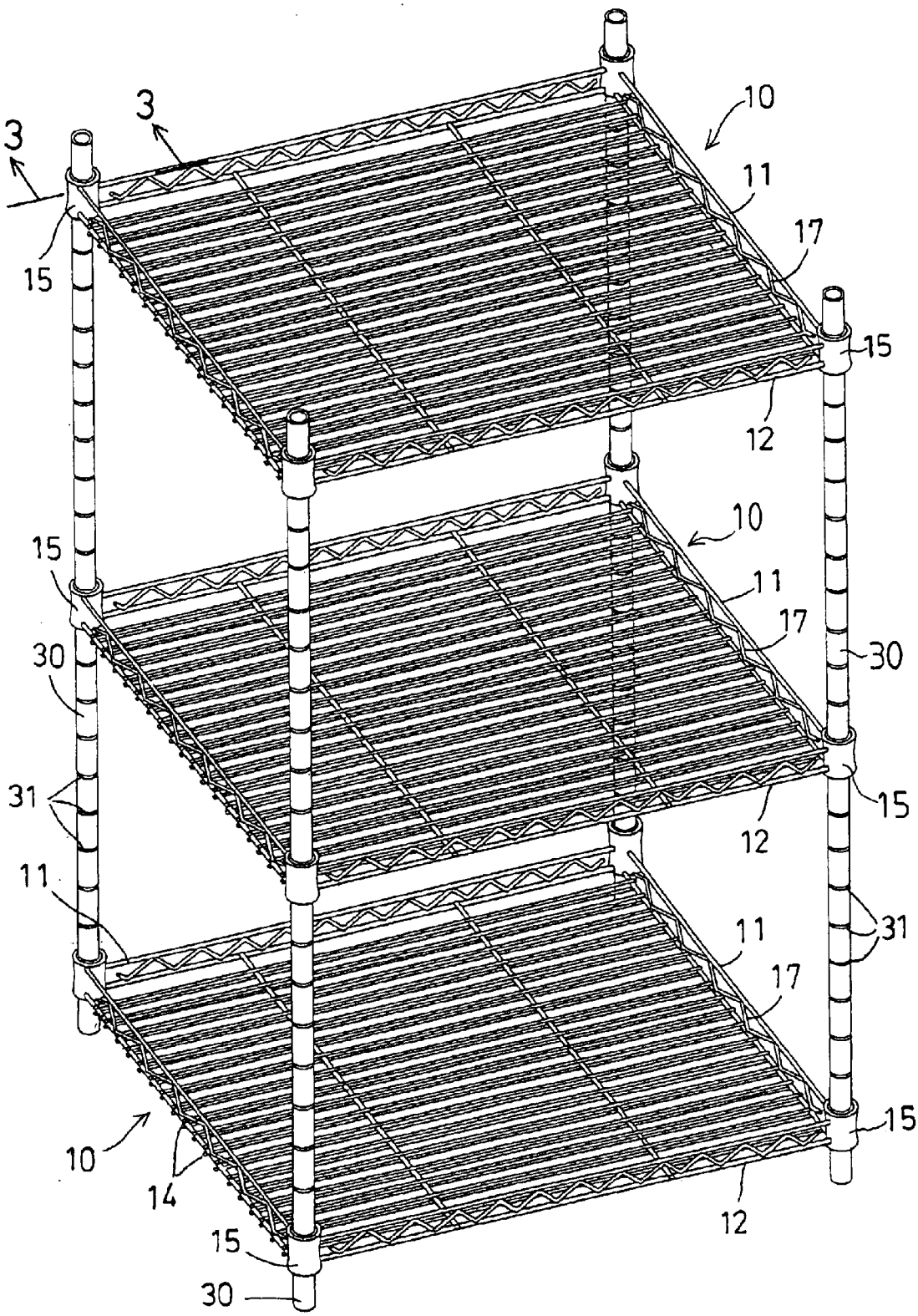
FIG. 1 is a perspective view of a rack device in accordance with the present invention.
Figure 2:
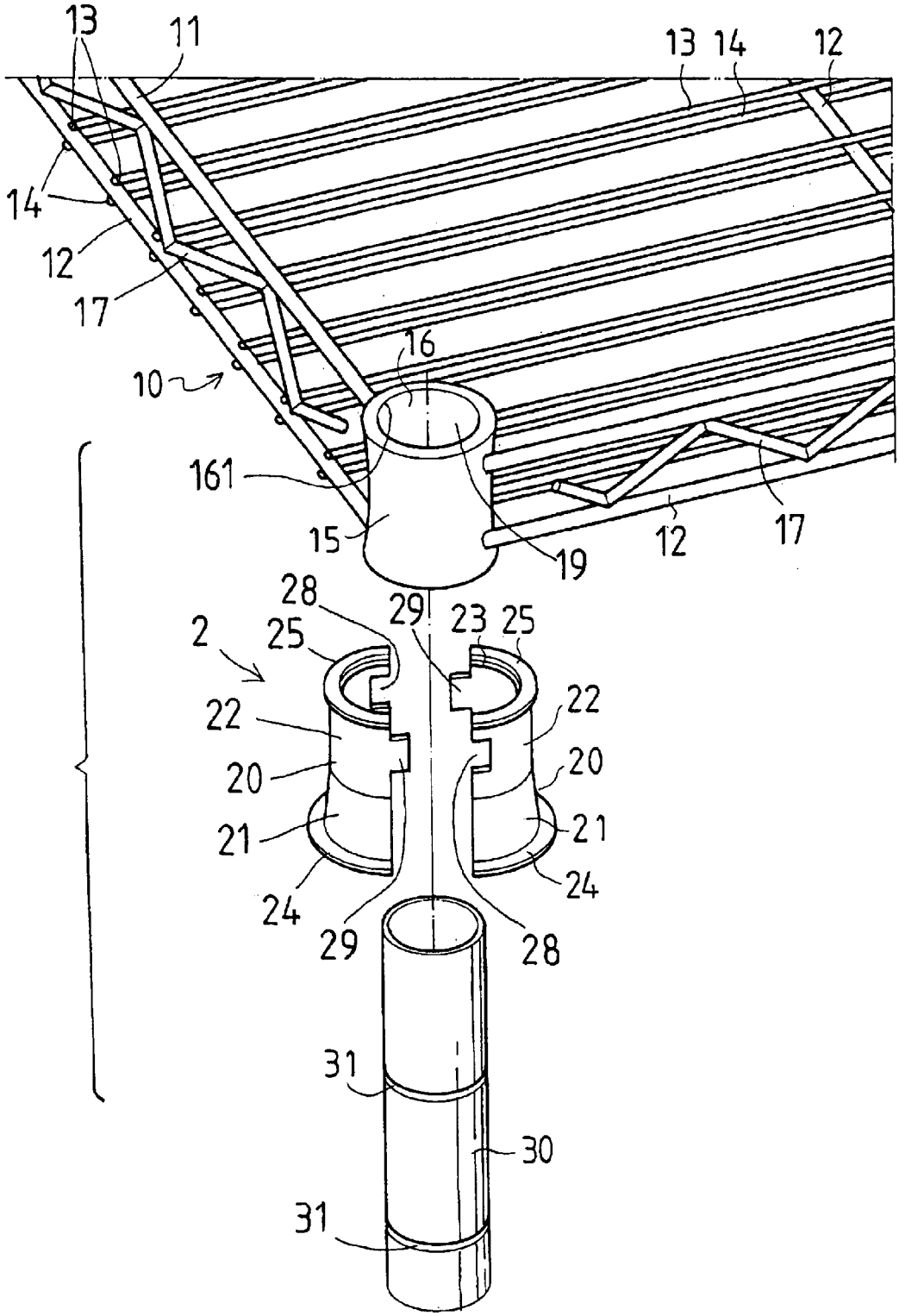
FIG. 2 is a partial exploded view of the rack device.
Figure 3:
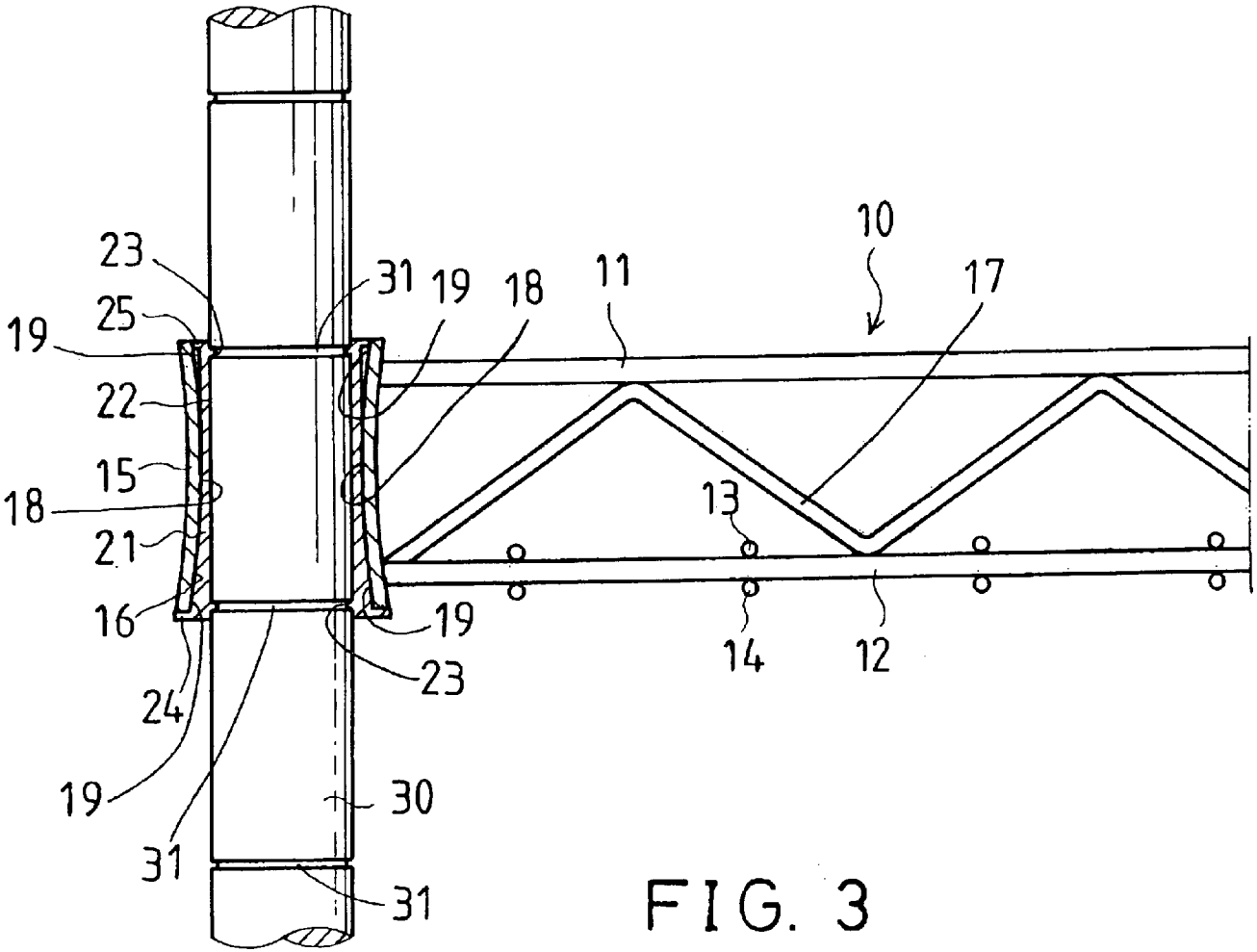
FIG. 3 is a partial cross sectional view taken along lines 3—3 of FIG. 1.

Referring to the drawings, and initially to FIGS. 1–3, a rack device in accordance with the present invention comprises one or more shelves 10 to be attached to and supported on one or more supporting posts 30, and to be reversible or invertible relative to the supporting posts 30.

Figure 5:
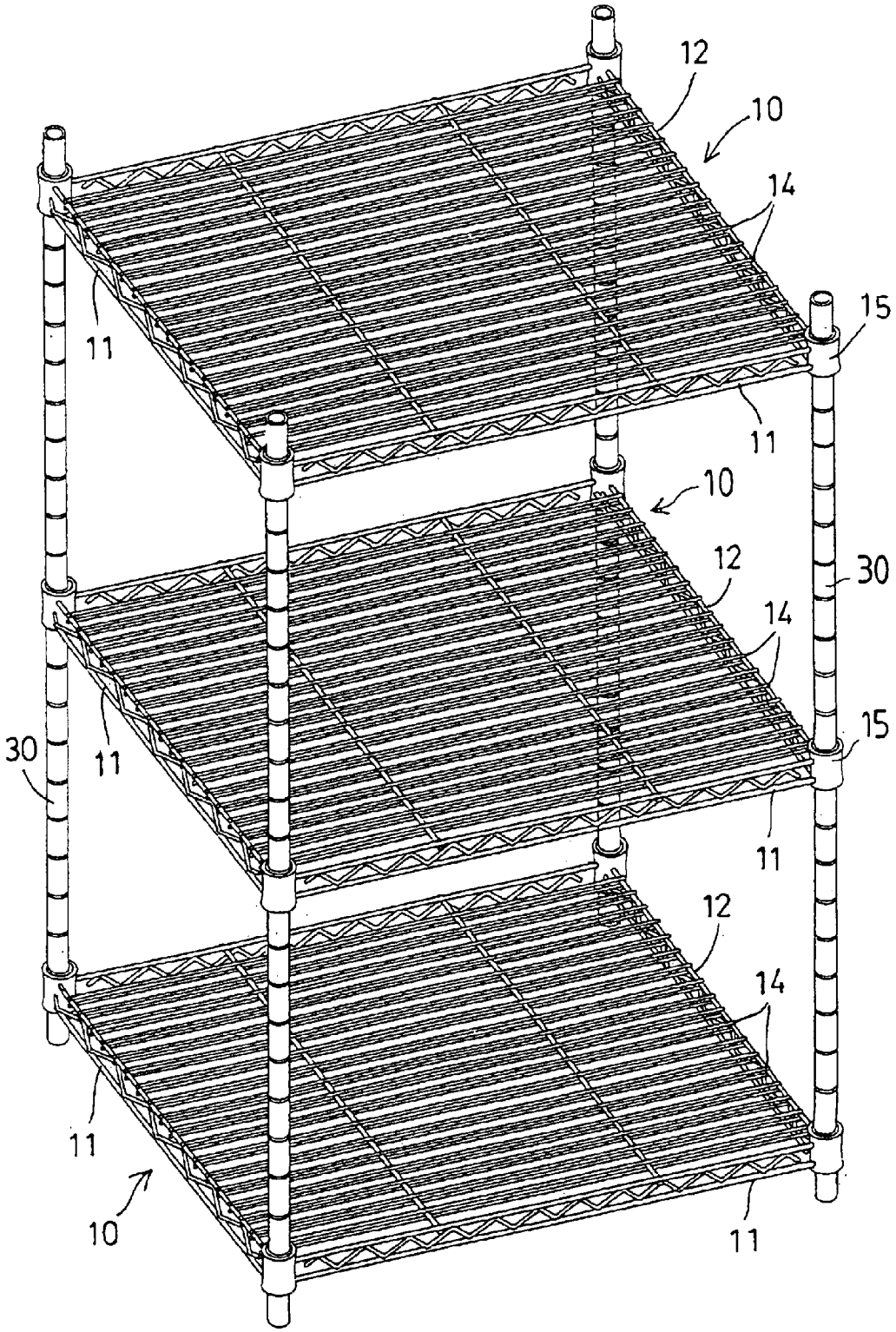
FIGS. 5, 6 are perspective views illustrating the operation of the rack device.
Figure 6:
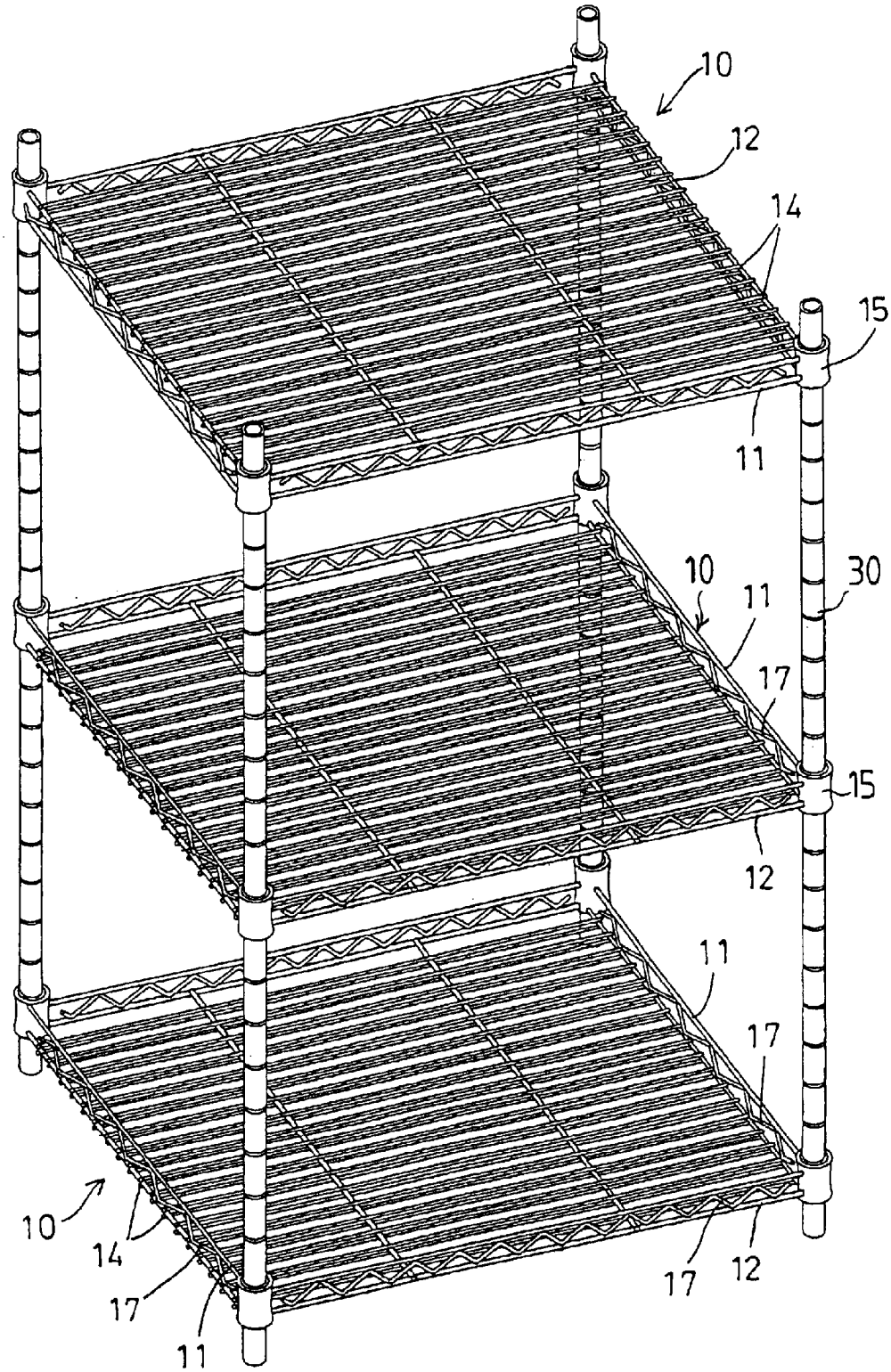

Each supporting post 30 includes a number of grooves 31 formed around and provided along the supporting posts 30, and preferably equally spaced from each other. As best shown in FIGS. 1, 5 and 6, there will be four supporting posts 30 attached to four corners of one or more shelves 10.

Each shelf 10 includes a planar base member 12, and a peripheral wall member 11 formed or provided or disposed around or extended from the peripheral portion of the planar base member 12, and preferably perpendicular to the planar base member 12.

The peripheral wall member 11 includes a number of wires 17 coupled or secured or welded together to form a planar or truss structure, and secured or welded to the peripheral portion of the planar base member 12. The planar base member 12 also includes a number of wires 13, 14 coupled or secured or welded together to form a planar structure, and perpendicular to the peripheral wall member 11.

Each shelf 10 includes one or more, such as four corners, each having a collar 15 attached thereto, and secured or welded between the planar base member 12 and the peripheral wall member 11. The collars 15 each includes a bore 16 formed therein for receiving the respective supporting posts 30 therein.

Figure 4:
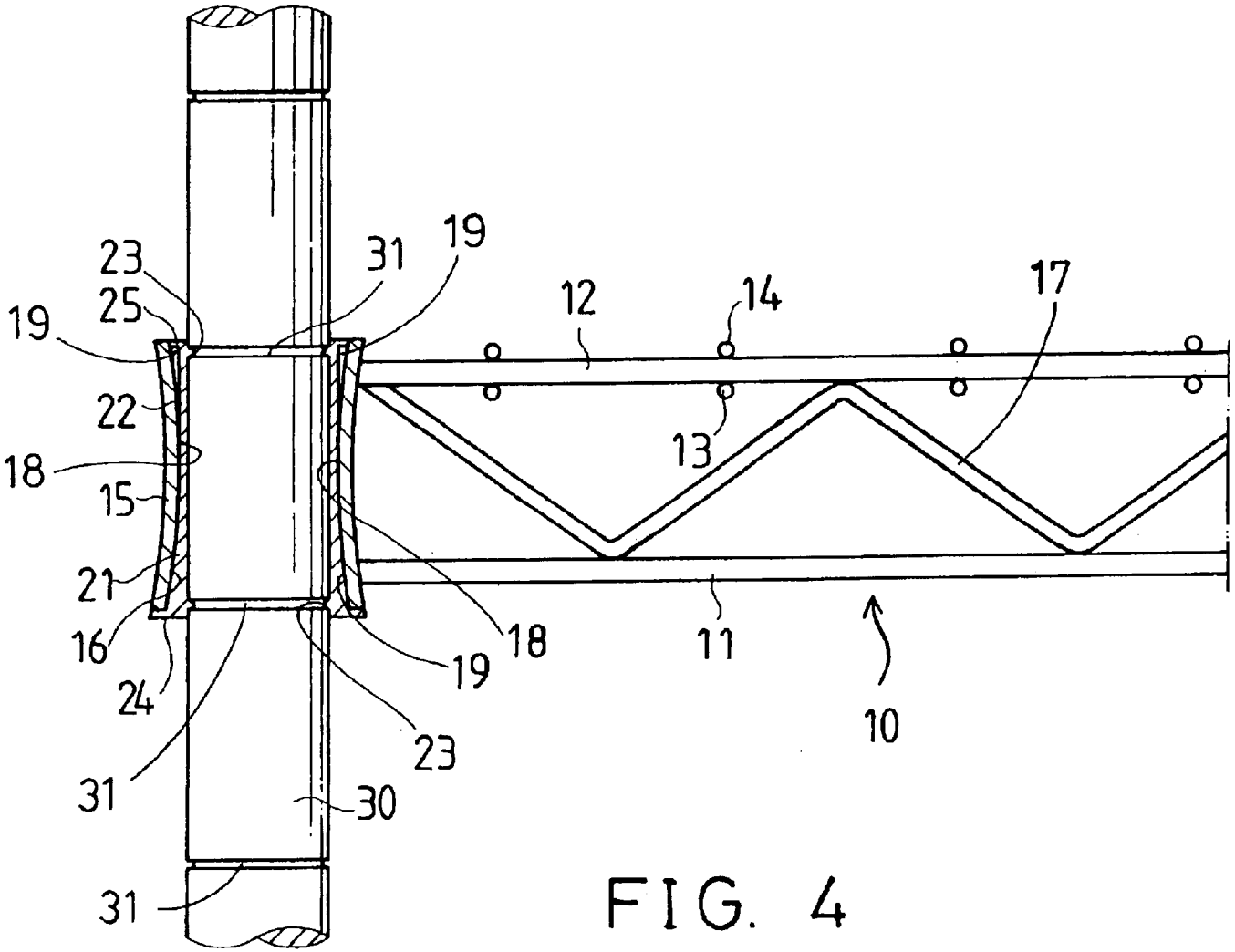
FIG. 4 is a partial cross sectional view similar to FIG. 3, illustrating the operation of the rack device.

As best shown in FIGS. 3 and 4, the bore 16 of the collar 15 includes a middle portion 18 having a smaller inner diameter than that of the two end portions 19 thereof. The collar 15 preferably includes a curved inner peripheral surface 161 (FIG. 2) provided therein for forming or defining the bore 16 thereof, and is inclined or opened or curved gradually and outwardly from the middle portion 18 toward the end portions 19 thereof.

A number of sleeves 2 are further provided to be secured between the supporting posts 30 and the respective collars 15. Each sleeve 2 preferably includes two halves 20 that may form a substantially cylindrical structure for the sleeve 2, when the two halves 20 are disposed close together.

One of the halves 20 of each sleeve 2 may include one or more notches 28 formed therein and/or one or more ears 29 extended therefrom (FIG. 2), and the other half 20 of the sleeve 2 may also include one or more ears 29 extended therefrom and/or one or more notches 28 formed therein, for engaging with the corresponding notches 28 and/or ears 29, and for allowing the halves 20 to be solidly secured together to form the sleeve 2.

Each sleeve 2 includes one or more peripheral ribs or stops 23 provided in the inner peripheral portion thereof, for engaging into the respective grooves 31 of the posts 30, and for solidly securing the sleeves 2 to the posts 30 with the collars 15, and for preventing the sleeves 2 and the collars 15 from moving relative to the supporting posts 30.

Each sleeve 2 includes a cylindrical upper member 22 having an outer diameter equal to or slightly smaller than that of the middle portion 18 of the bore 16 of the collar 15, for allowing the collars 15 to be engaged onto the respective sleeves 2, at least the cylindrical upper member 22 of the respective sleeve 2.

Each sleeve 2 further includes an inclined or frustum-shaped or truncated cone-shaped lower member 21 which includes a lower portion having an outer diameter greater than that of the middle portion 18 of the bore 16 of the collar 15, for allowing the collars 15 to be engaged onto or seated on and supported by the respective sleeves 2, particularly the lower members 21 of the sleeves 2.

Each sleeve 2 may further include a peripheral flange 24 extending radially and outwardly from the lower portion thereof, such as from the lower portion of the lower member 21, and having an outer diameter greater than the inner diameter of either end of the collar 15, allowing the ends of the collars 15 to be stably seated on the peripheral flange 24 of the sleeve 2.

It is preferable that the peripheral flange 24 of the sleeve 2 include an outer diameter about equal to the outer diameter of either end of the collar 15, for allowing the ends of the collars 15 to be flush with the peripheral flange 24 of the sleeve 2, and to form a smooth outer appearance.

Each sleeve 2 may further include a peripheral rib 25 extending radially and outwardly from the upper portion thereof, such as from the upper portion of the cylindrical upper member 22, and having an outer diameter no greater than the inner diameter of either end of the collar 15, for allowing the peripheral rib 25 of the sleeve 2 to be engaged into either end of the collar 15.

It is preferable that the peripheral rib. 25 of the sleeve 2 include an outer diameter about equal to the inner diameter of either end of the collar 15, for engaging with the inner peripheral surface 161 of the collar 15, and for allowing the ends of the bore 16 of the collars 15 to be enclosed by the peripheral rib 25 of the sleeve 2, and for preventing objects or insets or dirt from entering into the gap that may be formed between the sleeve 2 and the collar 15.

In operation, the shelves 10 may be attached onto the posts 30 and arranged to have the peripheral wall member 11 extended or provided above the planar base member 12, as shown in FIG. 1, for allowing objects to be safely received or confined or supported by the shelves 10.

As shown in FIG. 5, the planar base member 12 may also be arranged or supported above the peripheral wall member 11, for allowing the planar base member 12 to be supported and reinforced by the peripheral wall member 11, and for allowing the shelves 10 to support heavier objects.

As shown in FIG. 6, one or more shelves 10 may have the planar base member 12 arranged above the peripheral wall member 11 thereof and supported and reinforced by the peripheral wall member 11, and the other shelves 10 may have the peripheral wall member 11 disposed above the planar base member 12 for confining the objects on the shelves 10.

Figure 7:
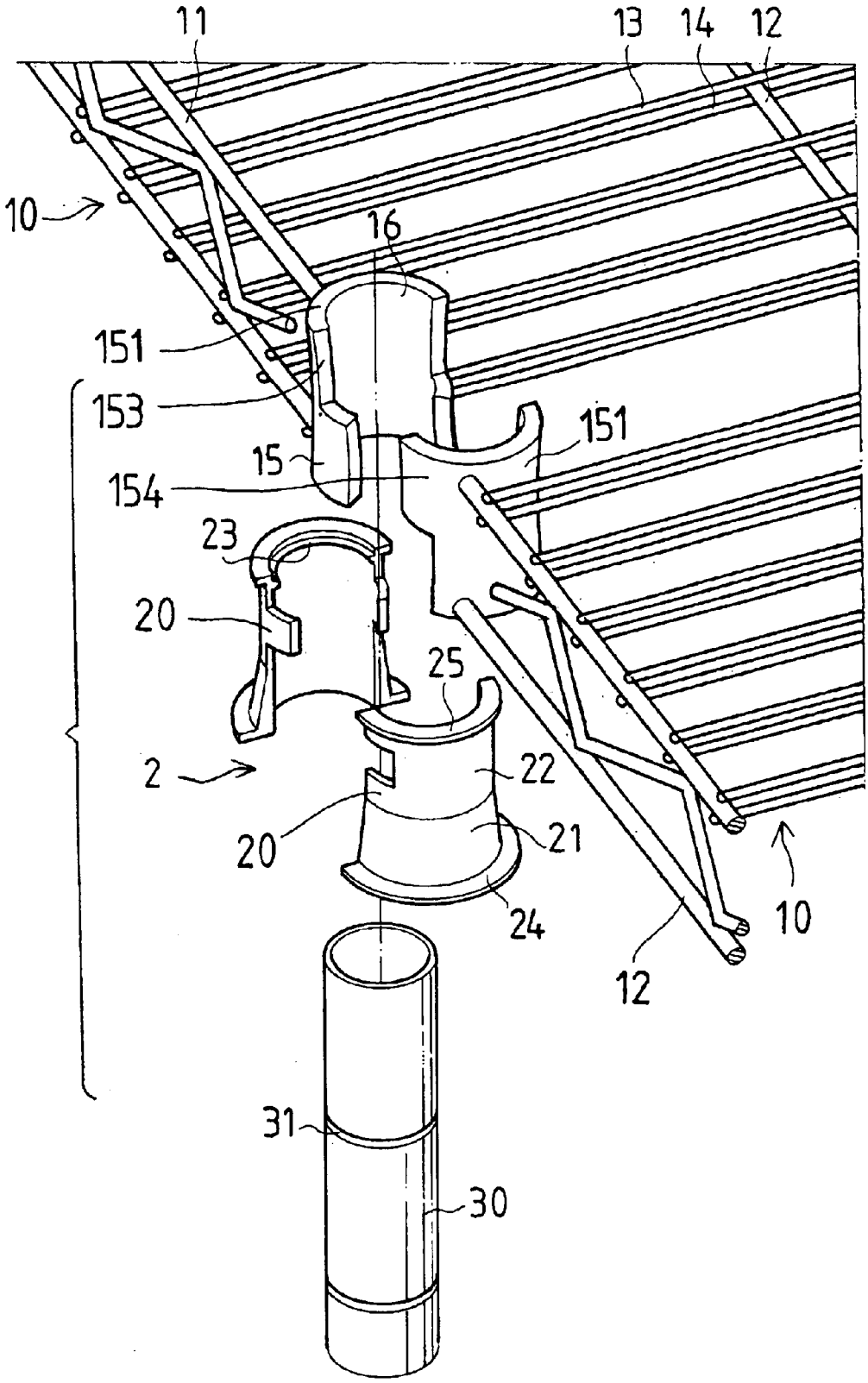
FIG. 7 is a partial exploded view illustrating another arrangement or application or embodiment of the rack device.
Figure 8:
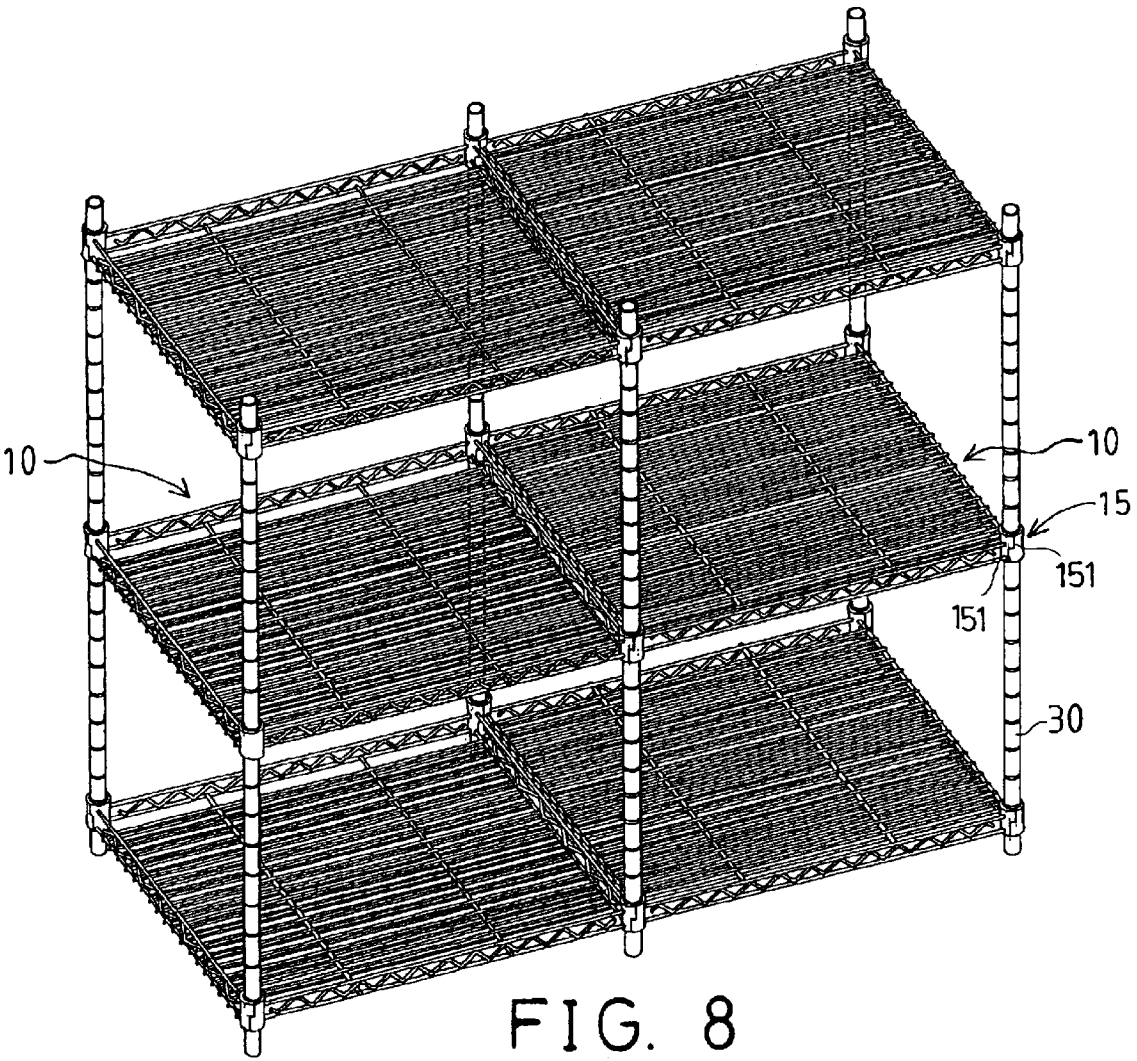
FIG. 8 is a perspective view illustrating the operation of the rack device as shown in FIG. 7.

Referring next to FIGS. 7 and 8, some of the collars 15 may preferably be formed by two halves 151, or each preferably includes two halves 151 that may form a substantially cylindrical structure for the collar 15, when the two halves 151 are disposed close together.

The collars 15 may include notches 153 and ears 154 engaged with each other for allowing the two halves 151 to be solidly secured together to form the collar 15, by such as welding processes. The halves 151 of the collars 15 may be secured to different shelves 10, for allowing the shelves 10 to be attached onto the posts 30 side by side.

Accordingly, the rack device in accordance with the present invention includes one or more reversible or invertible shelves, for allowing both sides of the shelves to be selectively used by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A rack device comprising:

at least one post, a sleeve engaged onto said at least one post, and including a lower portion having an outer diameter greater than an outer diameter of an upper portion thereof, a shelf, and at least one collar secured to said shelf, and including a bore formed therein for receiving said sleeve, and for securing said at least one collar and said shelf to said sleeve and said at least one post, said bore of said at least one collar including two end portions, and including a middle portion having an inner diameter smaller than an inner diameter of said end portions thereof, said inner diameter of said middle portion of said bore of said at least one collar being no less than said outer diameter of said upper portion of said sleeve, which permits either of said end portions of said bore of said at least one collar to receive said upper portion of said sleeve, and said outer diameter of said lower portion of said sleeve being greater than said inner diameter of said middle portion of said bore of said at least one collar, which retains said at least one collar on said sleeve when either of said end portions of said bore of said at least one collar receives said lower portion of said sleeve.

2. The rack device according to claim 1, wherein said lower portion of said sleeve includes a frustum-shaped structure.

3. The rack device according to claim 1, wherein said sleeve includes a peripheral flange extended from said lower portion thereof for engaging with said at least one collar, and for stably retaining said at least one collar on said sleeve.

4. The rack device according to claim 3, wherein said peripheral flange of said sleeve includes an outer diameter equal to that of said end portions of said at least one collar.

5. The rack device according to claim 1, wherein said sleeve includes a peripheral rib extended from said upper portion thereof.

6. The rack device according to claim 5, wherein said at least one collar includes an inner peripheral surface for defining said bore thereof, said peripheral rib of said sleeve is engaged with said inner peripheral surface of said at least one collar to enclose said bore of said at least one collar.

7. The rack device according to claim 1, wherein said sleeve includes a first half including at least one notch formed therein, and a second half having at least one ear extended therefrom and engageable into said at least one notch of said first half of said sleeve.

8. The rack device according to claim 1, wherein said at least one post includes an outer peripheral portion having a plurality of grooves formed therein, said sleeve includes at least one stop extended therefrom for engaging with either of said grooves of said at least one post.

9. The rack device according to claim 1, wherein said shelf includes a planar base member, and a peripheral wall member extended from a peripheral portion of said planar base member, and selectively disposed either above or below said planar base member.

* * * * *